US007270438B2

(12) United States Patent
Chen

(10) Patent No.: US 7,270,438 B2
(45) Date of Patent: Sep. 18, 2007

(54) LIGHTED BACKPACK

(76) Inventor: Jimmy Chen, 6FL, No. 35 Kuang Fu S. Road, Taipei (TW)

( * ) Notice: Subject to any disclaimer, the term of this patent is extended or adjusted under 35 U.S.C. 154(b) by 0 days.

(21) Appl. No.: 11/326,911

(22) Filed: Jan. 7, 2006

(65) Prior Publication Data

US 2007/0159808 A1 Jul. 12, 2007

(51) Int. Cl.
*F21V 21/108* (2006.01)

(52) U.S. Cl. ..... 362/108; 362/155; 362/156; 362/570

(58) Field of Classification Search ..... 362/108, 362/155, 158, 570
See application file for complete search history.

(56) References Cited

U.S. PATENT DOCUMENTS 5,070,436 A * 12/1991 Alexander et al. ..... 362/108
6,824,291 B2 * 11/2004 Vautrin et al. ..... 362/156
7,055,978 B2 * 6/2006 Worthington ..... 362/156
2004/0076000 A1 * 4/2004 Thorp ..... 362/154
2006/0002134 A1 * 1/2006 Capriola ..... 362/570

* cited by examiner

*Primary Examiner*—Ali Alavi
*Assistant Examiner*—William J Carter
(74) *Attorney, Agent, or Firm*—Clement Cheng, Esq.

(57) ABSTRACT

A backpack with compartments are accessible by fasteners and includes a front panel having padded areas, a middle panel extending in parallel with the front panel and having top and side extensions for joining with the front panel via a first reclosable fastener, a side panel joined with the middle panel at its lower edges, a back panel joined at its top and side edges to the middle panel via a second reclosable fastener, and a bottom panel for joining bottom edges of the front and rear panels along a borderline. A pair of shoulder straps adjustably connects between the top and bottom edges of the front panel. The borderline extends along a curved bottom end of the back panel and carries a glowing cable along the length thereof. The cable is optically connected with an LED, which is energized by a driver/controller through wires.

2 Claims, 5 Drawing Sheets

LIGHTED BACKPACK

BACKGROUND OF THE INVENTION

A. Field of the Invention

The present invention relates to a backpack. More particularly the present invention relates to a backpack with a safety glow.

B. Description of the Prior Art

Adding a light-emitting element to personal articles to make them glow in the dark has increased as more lighting elements are introduced. One recent development can be found in U.S. Pat. No. 6,673,277 to Joseph incorporated herein by reference disclosing making a light guide for fixtures in interior linear accents and signage displays where neon-like effect is desired. Whereas, using individual light emitting diodes as warning spotlights for jogger safety is also known in U.S. Pat. No. 5,456,032. However, when it comes to provide a backpack having wider and thus effective visible faces with illuminated expression of the user's presence to ambience, known prior arts do not suggest a practical solution that can be completely integrated into the manufacturing process of such baggage.

Personal wear illumination for driver awareness prevents accidents. Thus, it is also desirable to have personal wear illumination for higher positioned drivers in vehicles such as trucks and SUVs. So a backpack with an integrated illumination is an improved outdoor safety gear.

SUMMARY OF THE INVENTION

In accordance with the present invention, a backpack has a number of compartments each accessible by fasteners. The backpack includes a front panel having padded areas for the comfort of a user, at least one middle panel extending in parallel with the front panel and having an upper lateral extension for joining with the front panel via a first reclosable fastener, a side panel joined with the middle panel at its lower edges, a back panel joined at its top and side edges to the middle panel via a second reclosable fastener and a bottom panel for joining bottom edges of the front and rear panels along a borderline. A pair of shoulder straps is adjustably connected between the top and bottom edges of the front panel.

The borderline extends along a curved bottom end of the back panel and carries a glowing cable along the length thereof. Next, it is optically connected with an LED, which is energized by a driver/controller though wires. The driver/controller is contained in a pocket attached to the inner face of the back panel at its upper right corner. Alternatively, the pocket may be conveniently located on an outer surface of the side extension of the middle panel. A user switch of the driver/controller is exposed via an opening formed in the back panel.

The driver/controller contains a couple of 1.5V batteries and connected at its output to the LED through the wires to energize the same. The switch has three positions of OFF, solid ON and intermittent ON, one of which is selected by the user for a desired one of three different modes of backpack illumination.

The LED has at its flat bottom two electrodes extending in parallel. A first longer lead is anode to which the shorter one of the wires is soldered with a dielectric sleeve thereon while a second shorter lead is cathode to which the longer wire is soldered with another sleeve shielding the otherwise bare conductors.

The main body of the LED is inserted in the connector, which is a flexible tube sized to hold the LED with a tight grip. The remainder of the connector tightly holds a first end of the glowing cable. Along its length the cable may be curved to conform to the borderline of the backpack without impeding its glowing performance. The glowing cable is attached to the back panel and bottom panel at their junction through a transparent sleeve, which is made of an elongated strip of flexible material folded about the cable and onto itself forming an attachment flap. The flap is then placed between the back and bottom panels in the manufacturing step to be stitched together along seam lines as an integral part to the backpack assembly.

The driver/controller comprises a power supply such as two 1.5V batteries; a resister connected to the positive terminal of the thee-volt supply to limit the current though the LED to less than the maximum value permitted by the specifications of the LED used; a motion sensor connected at its one terminal to the cathode terminal of the LED; and a user switch having three terminal positions including OFF to break the line between the supply and the LED, a constant ON that connects the same line directly to the LED and an intermittent ON to for bypassing the circuit through the motion sensor.

Therefore, at the intermittent ON position, the driver/controller starts to supply the LED with an intermittent electric current with varying frequencies depending on the movements of the backpack wearer. When it is inactive, the motion sensor deenergizes the LED and thus the glowing cable when the backpack is laid down whereby a power loss from the batteries is minimized. Even a slight motion of the backpack on the user will move the top of the spring into contact with the post to activate the sensor to complete the LED driver circuit resulting in a highly visible glowing cable in the dark. Continued motions of the user keep the cable blink producing a long vibrating line of glow at the height of the wear's torso. To alert better, two or more sets of the glow cable and LED may be connected to the driver/controller in parallel with appropriate ratings of the components. Such glow cables may be fastened to the bottom panel and back panel in the respective attachment flaps of different heights fastened at the common seam line. The design of the glow cable can be varied for increased attentions by varying the borderlines of the bottom panel and back panel.

Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
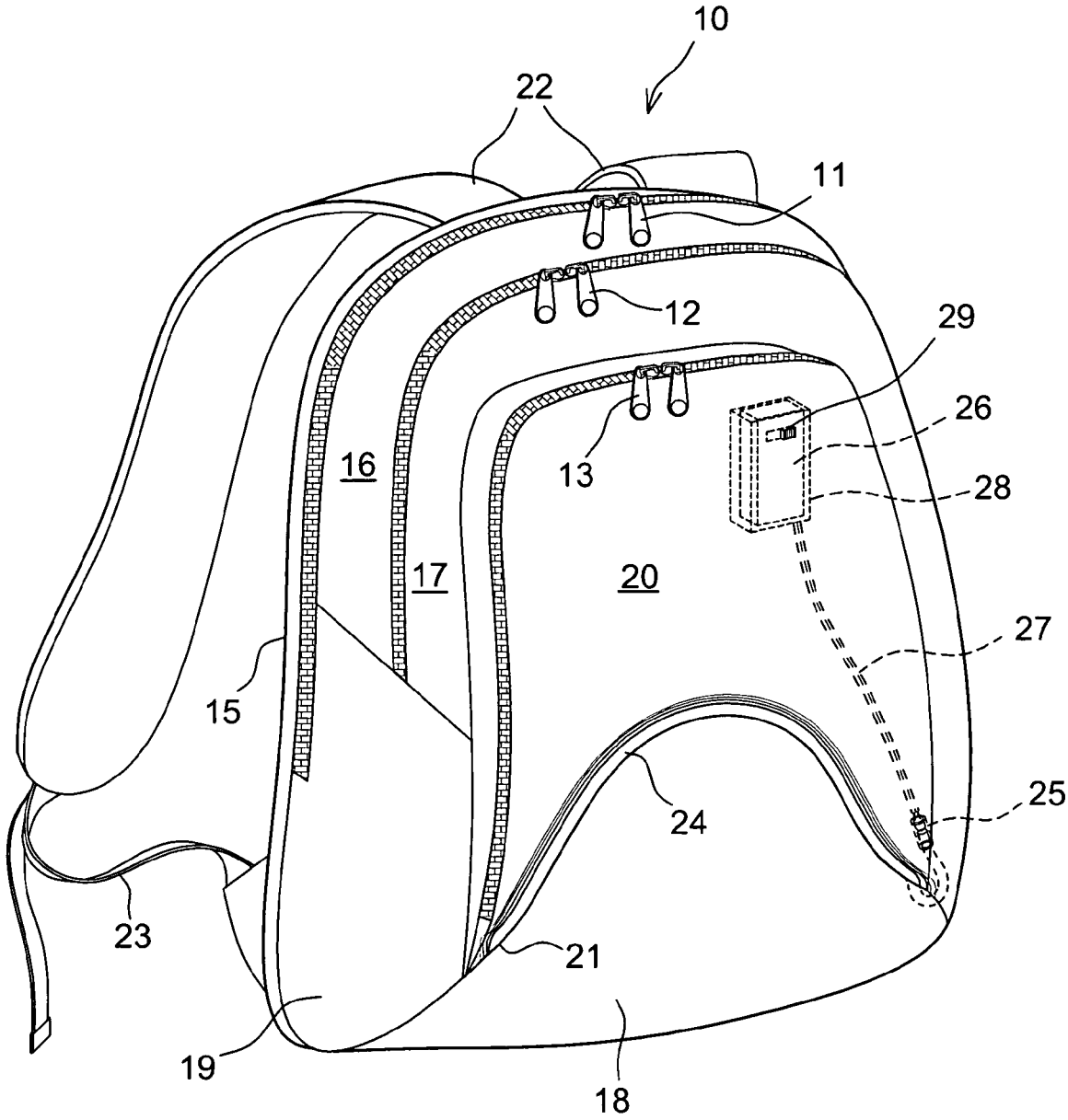
FIG. 1 is a perspective view of a first embodiment of a backlit backpack according to the present invention.

With reference to FIG. 1, a backpack 10 of the present invention is adapted to conveniently carry various personal effects in three separate partitioned compartments each accessible by slide fasteners 11 to 13. The backpack 10 includes a front panel 15 facing away from the drawing and having padded areas not shown, a couple of middle panels extending in parallel with the front panel 15 and having upper lateral extensions 16 and 17 which are shown to extend in arch joining with the first panel 15, a bottom panel 18 and two side panels, one of which is shown at 19. A back panel 20 borders all of the middle panel 17, bottom panel 18 and side panels 19 and defines an extended borderline 21 with the bottom panel 18.

At the top of the front panel 15 are fastened top ends of a pair of padded shoulder straps 22, the bottom ends of which are connected to adjusting straps 23 fastened in turn to the bottom of the front panel 15.

The borderline 21 extends along a curved bottom end of the back panel 20 and carries a glowing cable 24 along the length thereof. The glowing cable 24 can be obtained from Poly Optics Australia Pty, Ltd sold under the product name of "super side light fiber optic cable". It is a clear flexible fiber that refracts an end light with omnidirectional radiations. For the purpose of the present invention, the preferred diameter of the cable 24 is 4.5 mm. The cable 24 may be prepared to the length of 28 cm (11") or so as determined proportionally to the size of the backpack 10. Next, it is optically connected with an LED at a connector 25, which is energized by a driver/controller 26 though wires 27. In this embodiment, the driver/controller 26 is contained in a pocket 28 attached to the inner face of the back panel 20 at its upper right corner. A user switch 29 of the driver/controller is exposed via an opening formed in the back panel 20.

Figure 2:
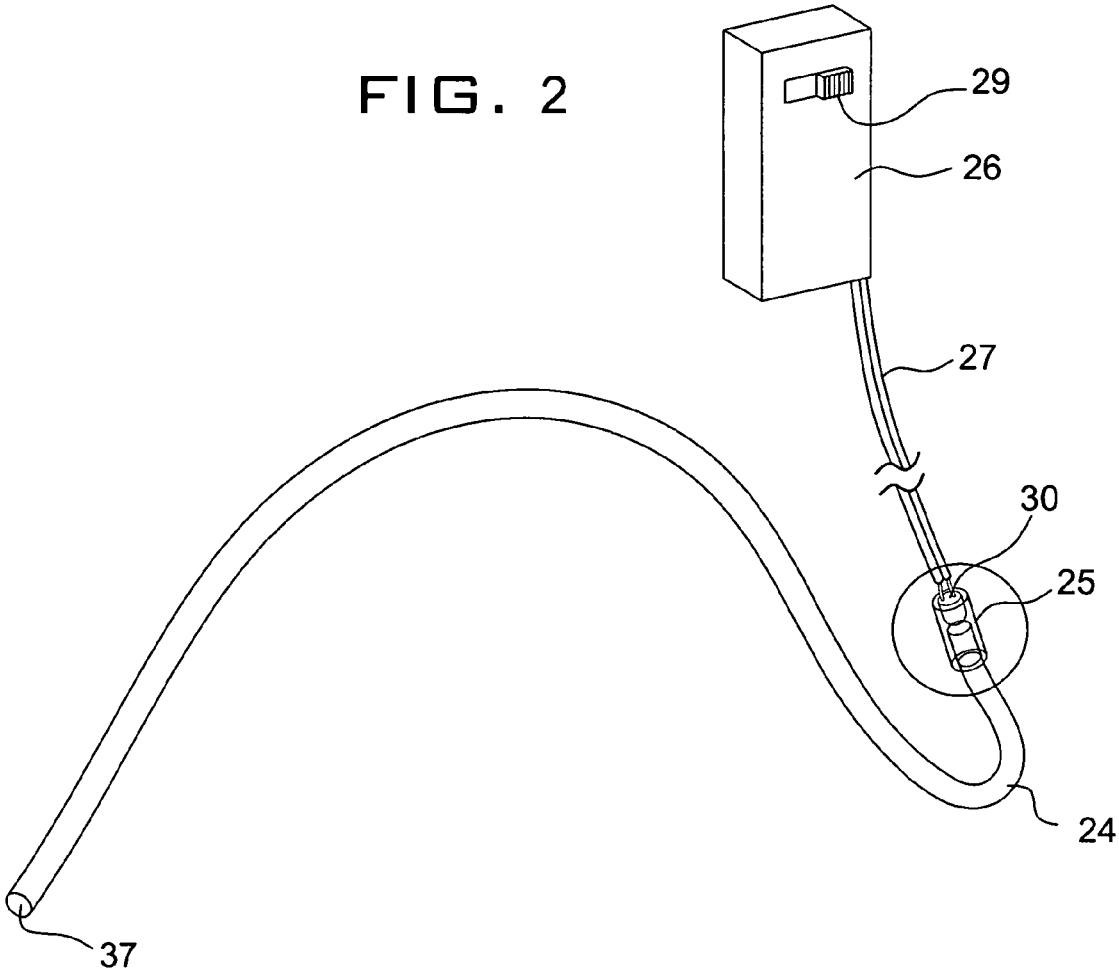
FIG. 2 is a perspective view of the wiring of the backlight element according to the present invention.
Figure 3:
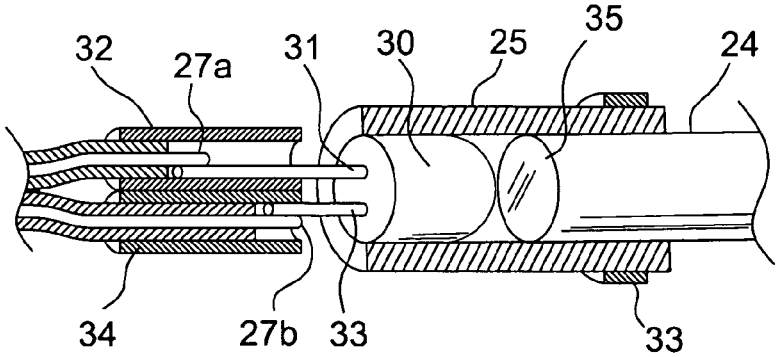
FIG. 3 is a partial cross-sectional view of the light connector in circle A of FIG. 2.

Referring to FIGS. 2 and 3, the connection of the driver/controller 26 to the glowing cable 24 are described in more detail. The driver/controller 26 contains a couple of 1.5V batteries not shown and connected at its output to an LED 30 through the wires 27 to energize the LED 30. The switch 29 has three positions of OFF, solid ON with "-ON" marked and intermittent ON with "- - - ON" marked, one of which is selected by the user for a desired one of three different modes of backpack illumination.

The LED 30 has at its flat bottom two electrodes extending in parallel. A first longer lead 31 is anode to which the shorter one of the wires 27 is soldered at a junction 27*a* with a dielectric sleeve 32 thereon while a second shorter lead 33 is cathode to which the longer wire 27 is soldered at a junction 27*b* with another sleeve 34 shielding the otherwise bare conductors.

The main body of the LED 30 is inserted in the connector 25, which is a flexible tube sized to hold the LED 30 with a tight grip. The remainder of the connector 25 tightly holds a first end 35 of the glowing cable 24. For added security, a tie 36 may be used to fasten the connector 25 and cable 24 together. The end 35 is preferably a flat surface perpendicular to the axis of the cable 24 and positioned close to the opposing end of the LED 30. Along its length the cable 24 may be curved to conform to the borderline 21 of the backpack 10 without impeding its glowing performance. The cable 24 is terminated at its other end by a free distal end 37, which is also preferred to have a flat surface perpendicular to the axis of the cable 24 to ensure proper refractions of light within the cable 24 and thus more effective light output thereof.

Figure 4:
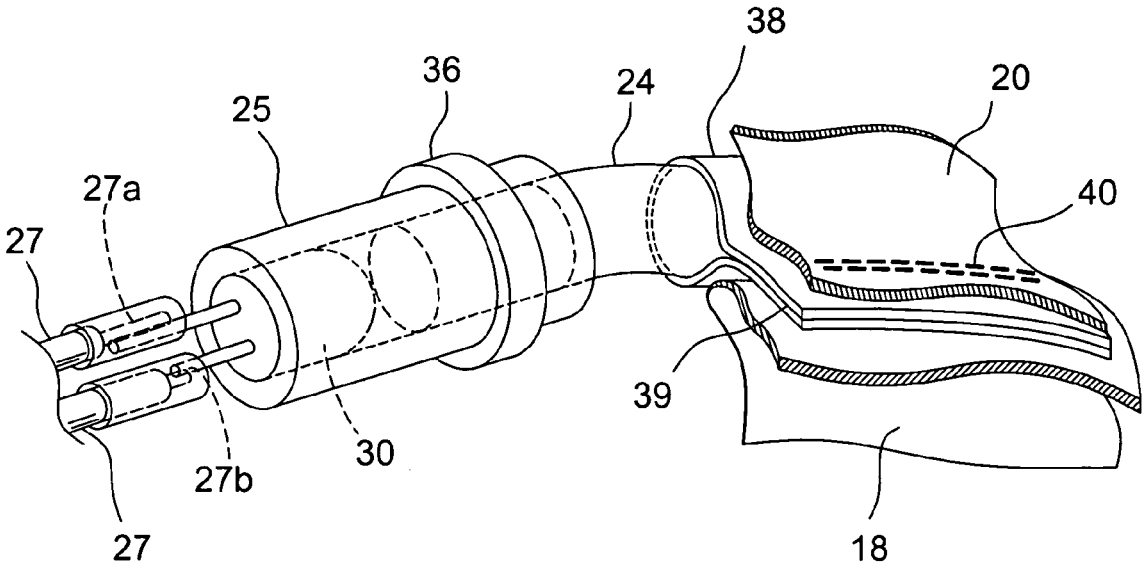
FIG. 4 is a perspective view of the glow cable sawn integral to the panels of the backpack.

In FIG. 4 the glowing cable 24 is attached to the back panel 20 and bottom panel 18 at their junction through a transparent sleeve 38, which is made of an elongated strip of flexible material folded about the cable 24 and onto itself forming an attachment flap 39. The flap 39 is then placed between the panels 18 and 20 in the manufacturing step to be stitched together along seam lines 40 as an integral part to the backpack assembly.

Figure 5:
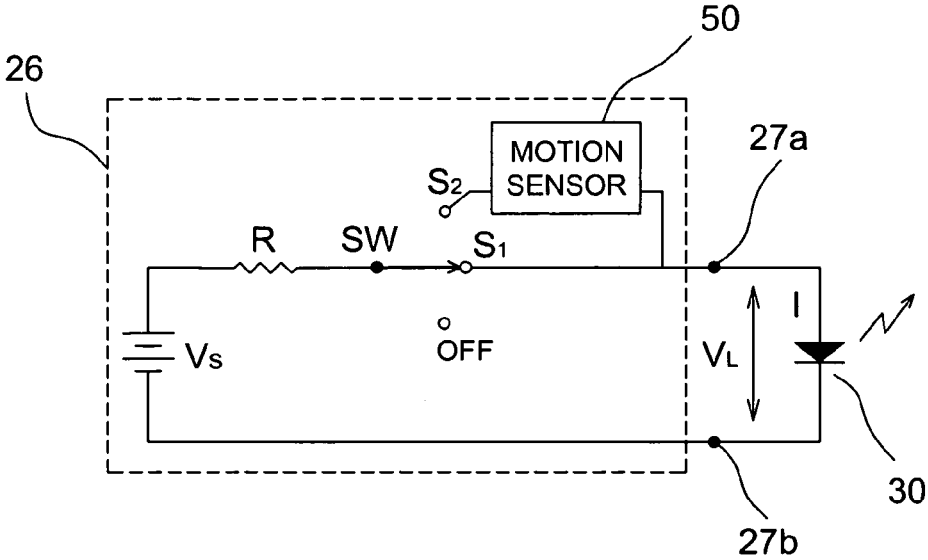
FIG. 5 is a circuit diagram of a driver/controller for controlling the operation of a light emitting diode used as a light source.

Now turning to FIG. 5, the driver/controller 26 is connected to the LED 30 via the junctions 27*a* and 27*b*. The driver/controller 26 comprises a power supply $V_s$ such as two 1.5V batteries; a resister R connected to the positive terminal of the thee-volt supply $V_s$ to limit the current though the LED 30 to less than the maximum value permitted by the specifications of the LED 30 used; a motion sensor 50 connected at its one terminal to the cathode terminal of the LED 30; and a user switch SW having three terminal positions including OFF to break the line between the supply $V_s$ and the LED 30, a terminal $S_1$ that connects the same line directly to the LED 30 and a terminal $S_2$ to for bypassing the circuit through the motion sensor 50.

The resistor value, R is given by $R=(V_s-V_L)/I$, wherein $V_s$ is supply voltage, $V_L$ is LED specification voltage and I is LED maximum current permitted. So if a 2V-20 mA LED is used, the register of 50 Ω may be chosen.

Figure 6:
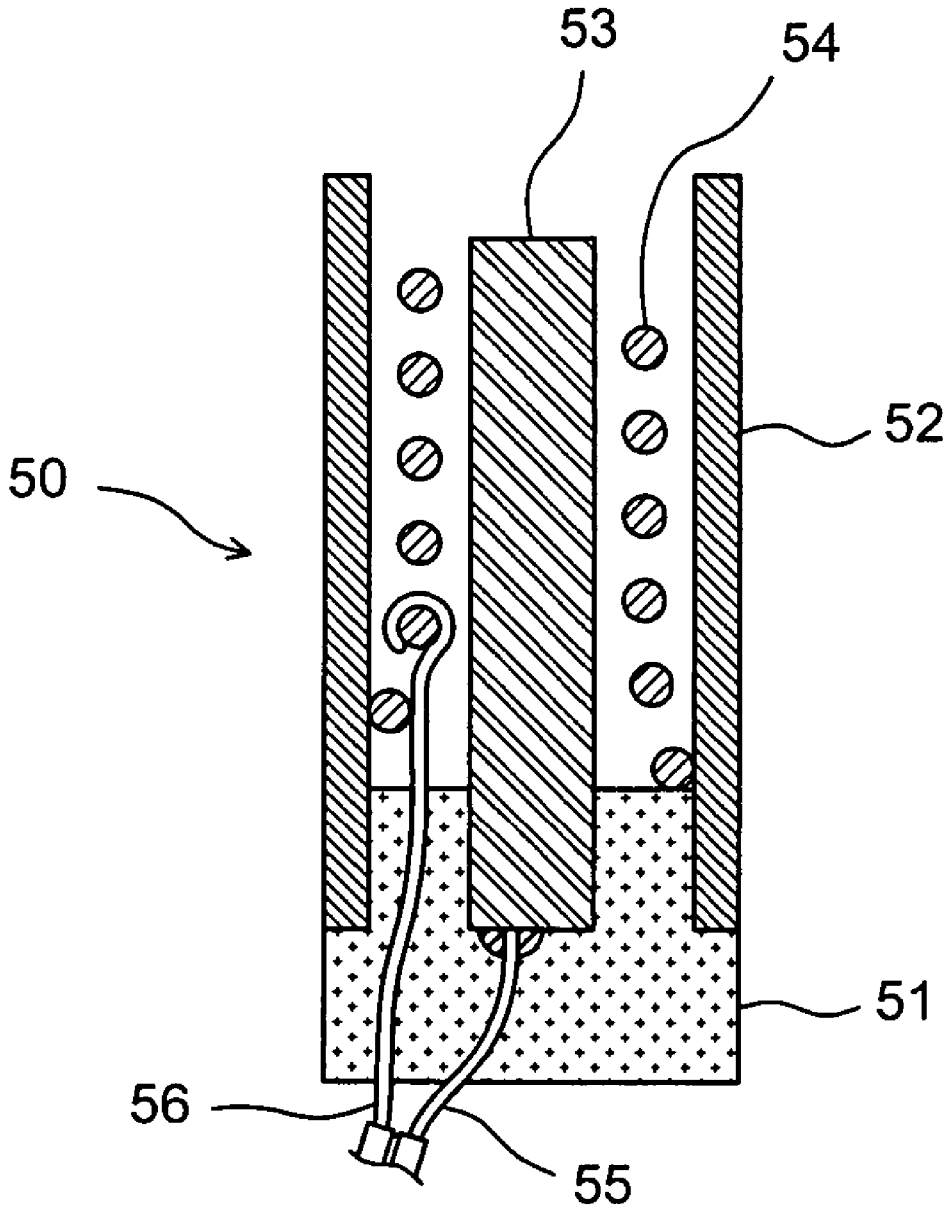
FIG. 6 is a detailed cross sectional view of the motion-switching sensor of the driver/controller.

Therefore, when the switch SW is positioned at terminal $S_1$, the supply voltage $V_s$ energizes the LED 30 constantly. At position $S_2$, the driver/controller 26 starts to supply the LED 30 with an intermittent electric current with varying frequencies depending on the movements of the backpack wearer. The detail of the motion-switching sensor 50 is illustrated in FIG. 6 wherein a dielectric base 51 holds a cylindrical housing 52 and a conductive post 53 in the center to which a first electric wire 54 is soldered from under the bottom of the base 51.

In an annular space formed between the housing 52 and post 53 a small conductive coil spring 55 is disposed. The lower end of the spring 55 abuts the inner walls of the housing 52 and the top surface of the base 51 and is wedged therebetween. A second wire 56 extends through the base 51 from under the same and is joined to the spring 55 by crimping or soldering. On the other hand, the top end of the spring 55 is positioned in proximity to the post 53 without touching it at a stand still. One of the wires 54 and 56 is connected to the terminal $S_2$ and the other is connected to the junction 27*a*.

The inactive motion sensor 50 deenergizes the LED 30 and thus the glowing cable 24 when the backpack 10 is laid down whereby a power loss from the batteries $V_s$ is minimized. Even a slight motion of the backpack on the user will move the top of the spring 55 into contact with the post 53 to activate the sensor 50 to complete the LED driver circuit resulting in a highly visible glowing cable 24 in the dark. Continued motions of the user keep the cable 24 blink producing a long vibrating line of glow at the height of the wear's torso.

Figure 7:
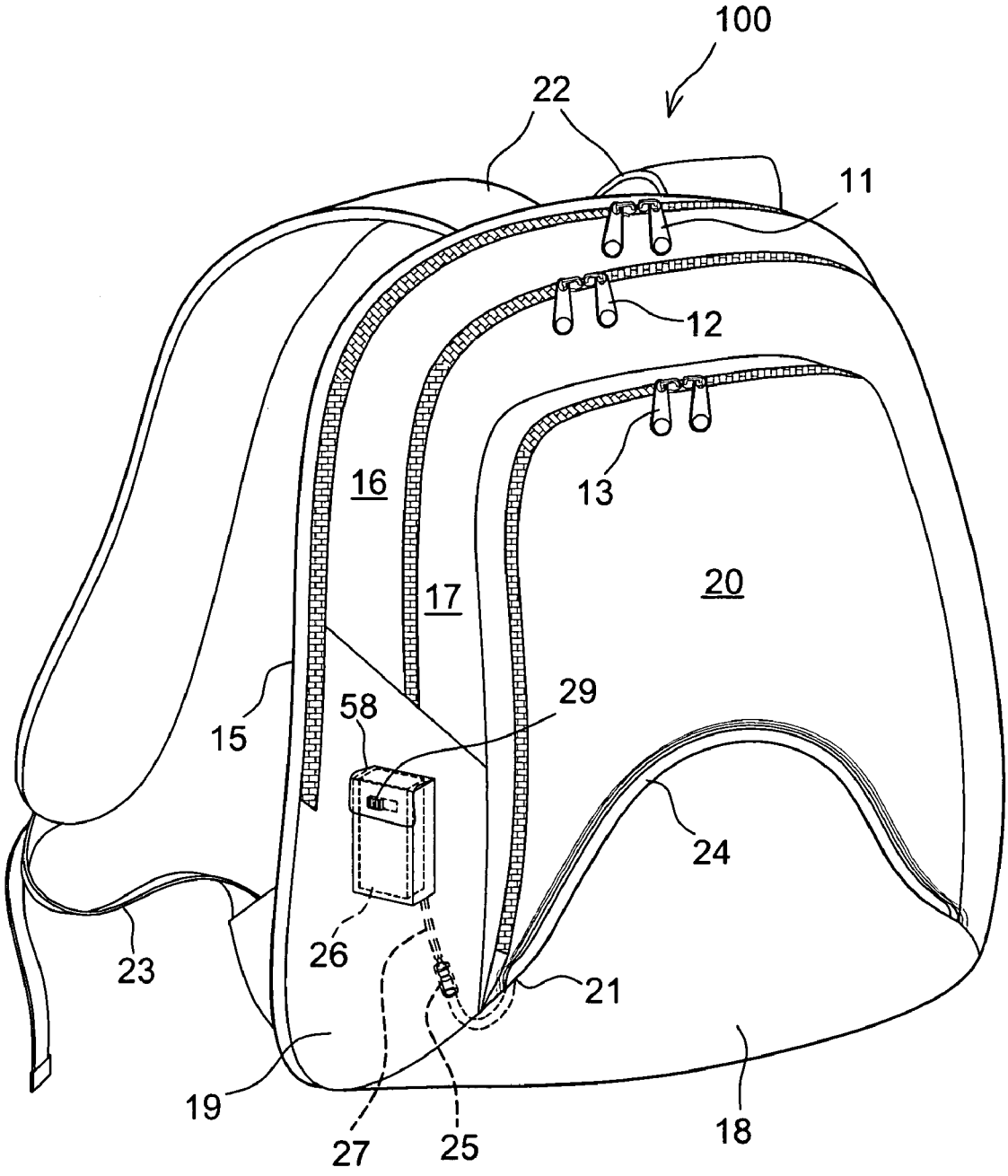
FIG. 7 is a perspective view of a second embodiment of a backlit backpack according to the present invention showing an alternative location of user switch at the side.

FIG. 7 shows another embodiment of the present invention wherein the similar backpack 100 to the first embodiment has the driver/controller 26 relocated to a pouch 58 attached to the outer surface of the side panel 19. At this position, the driver/controller 26 is easy for the backpack carrier to locate the switch for switching the cable light on or off or to replace the batteries.

Therefore, while the presently preferred form of the backlit backpack has been shown and described, and several modifications thereof discussed, persons skilled in this art will readily appreciate that various additional changes and modifications may be made without departing from the spirit of the invention, as defined and differentiated by the following claims. For example, although the above embodiments illustrate the slide-type controller switch 29 a conveniently located pull-cord switch may be used instead. In addition, two or more sets of the glow cable 24 and LED 30 may be connected to the driver/controller 26 in parallel with appropriate ratings of the components described above. Such glow cables may be fastened to the bottom panel 18 and back panel 20 in the respective attachment flaps 39 of different heights fastened at the common seam line 40. The design of the glow cable 24 can be varied for increased attentions by varying the border lines of the bottom panel 18 and back panel 20.

The best mode is to include the rubberized push button on off switch or an equivalent thereof in the shoulder strap. A user may control the light using the shoulder strap control unit. The batteries may also be located in the shoulder strap control unit.

CALL OUT LIST OF ELEMENTS

10 Backpack
11-13 Slide Fasteners
15 Front Panel
16,17 Middle Panel Extensions
18 Bottom Panel
19 Side Panel
20 Back Panel
21 Borderline
22 Shoulder Strap
23 Adjusting Strap
24 Glowing Cable
25 Connector
26 Driver/Controller
27 Wires
28 Pocket
29 Switch
30 LED
31 Anode
32,34 Dielectric Sleeve
33 Cathode
35 Cable End
36 Tie
37 Distal End
38 Transparent Sleeve
39 Attachment Flap
40 Seam Lines
50 Motion Sensor
51 Dielectric Base
52 Housing
53 Conductive Post
54,56 Wire
55 Spring
58 Pouch

The invention claimed is:

1. A backpack for carrying articles comprising:

a plurality of fabric panels stitched together to define compartments including a front panel, at least one middle panel extending in parallel with the front panel and having upper lateral extensions for joining with the front panel via a first reclosable fastener, a side panel joined with the middle panel at its lower edges, back panel joined at its top and side edges to the middle panel via a second reclosable fastener and a bottom panel for joining bottom edges of the front and rear panels, the bottom panel defining a borderline between the rear panel;

a pair of shoulder straps adjustably connected between the top and bottom edges of the front panel;

a linear glowing member with a flap extension stitched integral to the back and bottom panels along the borderline;

a light emitting member having a pair of leads of an anode and a cathode and a light emitting head held in close proximity with an end of the glowing member; and a remote driving means located in the inner surface of the outer surface of the side extension of the middle panel back panel and connected electrically to the leads of the light emitting member for controllably energizing the glowing member so that a bright line is visible on the back of the person carrying the backpack to alert the presence of the person in a darker environment, wherein the driving means is connected to the light emitting member and comprises a power supply, a resistor connected between the power supply and the anode of the light emitting member for limiting the current to the anode, a primary switch having three terminals defining different lighting options and connected between the resister and the anode, and a motion activated switch connected between one of the three terminals and the anode, wherein the motion sensor has a dielectric base holding a cylindrical housing and a conductive post in the center with an annular space between the housing and post to which a first electric wire is soldered and a conductive coil spring held in the annular space with a close distance to the post under spring bias to which spring a second wire is soldered, one of the first and second wires being connected to one of the three terminals for motion activated illumination and the other wire being connected to the anode of the light emitting member.

2. A backpack for carrying articles in the back area of a person comprising:

a plurality of fabric panels stitched together to define compartments including a generally rectangular front panel, at least one middle panel extending in parallel with the front panel and having upper lateral extensions for joining with the front panel via a first reclosable fastener, a side panel joined with the middle panel at its lower edges, a back panel joined at its top and side edges to the middle panel via a second reclosable fastener and a bottom panel for joining bottom edges of the front and rear panels, the bottom panel defining a borderline between the rear panel;

a pair of shoulder straps adjustably connected between the top and bottom edges of the front panel;

a linear glowing member with a flap extension stitched integral to the back and bottom panels along the borderline;

a light emitting member having a pair of leads of an anode and a cathode and a light emitting head held in close proximity with an end of the glowing member; and a remote driving means located in the outer surface of the side extension of the middle panel and connected electrically to the leads of the light emitting member for controllably energizing the glowing member so that a bright line is visible on the back of the person carrying the backpack to alert the presence of the person in a darker environment, wherein the driving means is connected to the light emitting member and comprises a power supply, a resister connected between the power supply and the anode of the light emitting member for limiting the current to the anode, a primary switch having three terminals defining different lighting options and connected between the resister and the anode, and a motion activated switch connected between one of the three terminals and the anode wherein the motion sensor has a dielectric base holding a cylindrical housing and a conductive post in the center with an annular space between the housing and post to which a first electric wire is soldered and a conductive coil spring held in the annular space with a close distance to the post under spring bias to which spring a second wire is soldered, one of the first and second wires being connected to one of the three terminals for motion activated illumination and the other wire being connected to the anode of the light emitting member.

* * * * *